US010704198B2

(12) United States Patent
Nagai et al.

(10) Patent No.: US 10,704,198 B2
(45) Date of Patent: Jul. 7, 2020

(54) SHEET MANUFACTURING APPARATUS AND SHEET MANUFACTURING METHOD

(71) Applicant: SEIKO EPSON CORPORATION, Tokyo (JP)

(72) Inventors: Yoshiyuki Nagai, Nagano (JP); Hiroshi Tanaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 349 days.

(21) Appl. No.: 15/516,496

(22) PCT Filed: Dec. 16, 2015

(86) PCT No.: PCT/JP2015/006278
§ 371 (c)(1),
(2) Date: Apr. 3, 2017

(87) PCT Pub. No.: WO2016/113803
PCT Pub. Date: Jul. 21, 2016

(65) Prior Publication Data
US 2018/0237992 A1 Aug. 23, 2018

(30) Foreign Application Priority Data

Jan. 13, 2015 (JP) ..... 2015-003937
Nov. 13, 2015 (JP) ..... 2015-222776

(51) Int. Cl.
*D21G 1/02* (2006.01)
*D04H 1/558* (2012.01)
(Continued)

(52) U.S. Cl.
CPC ..... *D21G 1/028* (2013.01); *D04H 1/54* (2013.01); *D04H 1/558* (2013.01); *D06C 15/02* (2013.01);
(Continued)

(58) Field of Classification Search
CPC ..... D21F 3/281
(Continued)

(56) References Cited

U.S. PATENT DOCUMENTS 4,568,275 A * 2/1986 Sakurai ..... G03G 15/206 219/216
4,685,389 A 8/1987 Boissevain
(Continued)

FOREIGN PATENT DOCUMENTS

EP 0867550 A1 9/1998
EP 1098229 A1 * 5/2001 ..... G03G 15/2064
(Continued)

OTHER PUBLICATIONS

Hiroaki: JP-2001113509-A Translation, Apr. 2001.*
(Continued)

*Primary Examiner* — Adam J Eiseman
*Assistant Examiner* — Matthew Kresse
(74) *Attorney, Agent, or Firm* — Global IP Counselors, LLP

(57) ABSTRACT

A sheet manufacturing apparatus has a heating/compressing unit configured to form a sheet by heating and compressing material including fiber and resin, and the heating/compressing unit includes a first rotating body that rotates, and a second rotating body that rotates in contact with the first rotating body. The sheet manufacturing apparatus holds, heats, and compresses material by the first rotating body and the second rotating body. The sheet manufacturing apparatus includes a heating unit that heats the outside surface of at least one of the first rotating body and second rotating body.

19 Claims, 5 Drawing Sheets

(51) Int. Cl.

| | |
|---|---|
| ***D06C 15/02*** | (2006.01) |
| ***D04H 1/54*** | (2012.01) |
| ***D04H 1/60*** | (2006.01) |
| ***D04H 1/732*** | (2012.01) |

(52) U.S. Cl.
CPC ..... *D21G 1/0233* (2013.01); *D21G 1/0286* (2013.01); *D04H 1/60* (2013.01); *D04H 1/732* (2013.01)

(58) Field of Classification Search
USPC ..... 26/18.5, 18.6; 100/327, 328, 330, 332, 100/334
See application file for complete search history.

(56) References Cited

U.S. PATENT DOCUMENTS

| | | | | |
|---|---|---|---|---|
| 4,768,433 | A | 9/1988 | Baissevain | |
| 4,823,688 | A * | 4/1989 | Wedel | B30B 15/34 15/34 |
| 6,274,522 | B1 | 8/2001 | Sameshima et al. | |
| 6,349,637 | B1 | 2/2002 | Molteni | |
| 6,567,641 | B1 * | 5/2003 | Aslam | G03G 15/2053 219/216 |
| 7,024,144 | B2 * | 4/2006 | Akita | G03G 15/2053 219/216 |
| 2002/0042237 | A1 | 4/2002 | Sameshima et al. | |
| 2004/0031571 | A1 * | 2/2004 | Lin | G03G 15/2053 219/216 |
| 2005/0251976 | A1 | 11/2005 | Lipponen et al. | |
| 2005/0251977 | A1 | 11/2005 | Lipponen et al. | |
| 2006/0060322 | A1 | 3/2006 | Vijanmaa et al. | |
| 2008/0070463 | A1 | 3/2008 | Arora et al. | |
| 2012/0107016 | A1 * | 5/2012 | Yamaji | G02B 3/0031 399/130 |
| 2014/0290889 | A1 | 10/2014 | Oguchi et al. | |
| 2017/0114484 | A1 * | 4/2017 | Tsujino | D04H 1/736 |

FOREIGN PATENT DOCUMENTS

| | | | |
|---|---|---|---|
| JP | 61-231296 | A | 10/1986 |
| JP | 07-026451 | A | 1/1995 |
| JP | 09-158024 | A | 6/1997 |
| JP | 2001113509 | A * | 4/2001 |
| JP | 2002-536564 | A | 10/2002 |
| JP | 2007-514067 | A | 5/2007 |
| JP | 2009-150045 | A | 7/2009 |
| JP | 2014-208927 | A | 11/2014 |
| WO | 2005/056921 | A1 | 6/2005 |

OTHER PUBLICATIONS

Hiroaki: JP-2001113509-A Translation, Apr. 2001 (Year: 2001).*
The Extended European Search Report for the corresponding European Patent Application No. 15877759.9 dated Jul. 3, 2018.

* cited by examiner

SHEET MANUFACTURING APPARATUS AND SHEET MANUFACTURING METHOD

TECHNICAL FIELD

The present invention relates to a sheet manufacturing apparatus and a sheet manufacturing method.

BACKGROUND

Sheet manufacturing apparatuses conventionally use a wet process in which feedstock containing fiber is soaked in water, defibrated by primarily a mechanical action, and then screened. Such wet-process sheet manufacturing apparatuses require a large amount of water and are large. Maintenance of the water treatment facilities is also time-consuming, and energy consumption by the drying process is great. As a result, dry process sheet manufacturing apparatuses that use very little water have been proposed to reduce device size and energy consumption. For example, a dry paper-making method that defibrates paper shreds in a dry defibrator and forms paper is described in PTL 1.

CITATION LIST

Patent Literature

[PTL 1] JP-A-H07-026451

SUMMARY OF INVENTION

Technical Problem

The dry paper-making method described in PTL 1 mists a styrene-butadiene rubber latex onto a mat of dry-formed fiber, which is then heated and compressed through hot pressure rollers to form a paper product. The device described in PTL 1 has hot pressure rollers configured in multiple stages, and such multi-stage rollers are thought necessary to apply heat sufficient to melt the styrene-butadiene latex to the mat.

A pair of heat rollers is generally used as a means of heating and compressing such a mat or other continuous molding, but when a large amount of heat is applied to the mat, for example, methods that configure heat roller pairs in multiple stages to increase the contact time (contact area) between the rollers and mat as described in PTL 1 are also used. However, the number of roller pairs increases with such methods, and constructing a small manufacturing apparatus becomes more difficult.

To apply greater heat to the mat, methods of reducing the hardness of the rollers and increasing the contact area, called the nip width, between the roller and mat are conceivable. However, the material (such as foam) used to make soft rollers may deteriorate quickly with such methods depending on the temperature of the applied heat, shortening roller life, reducing reliability, and necessitating more frequent equipment maintenance.

An objective of one or more embodiments of the invention is to provide a sheet manufacturing apparatus having a welding unit that efficiently heats and compresses material and can be compactly configured.

Solution to Problem

The present invention is directed to solving the foregoing problem, and can be realized through the embodiments and examples described below.

One aspect of a sheet manufacturing apparatus according to the invention has a heating/compressing unit configured to heat and compress material including fiber and resin and form a sheet, the heating/compressing unit including a first rotating body that rotates, and a second rotating body that rotates in contact with the first rotating body, the sheet manufacturing apparatus holding, heating, and compressing the material by the first rotating body and the second rotating body; and comprising a heating unit that heats the outside surface of at least one of the first rotating body and second rotating body.

Because this sheet manufacturing apparatus applies heat from the outside surface to the heating/compressing unit that heats material, and heats the material by said outside surface, there is little dissipation of heat, no need to produce unnecessary heat, and material containing fiber and resin can be heated with good thermal efficiency and compressed to form a sheet.

In a sheet manufacturing apparatus according to the invention, the first rotating body and second rotating body are rollers; the heating unit is a heat roller with an internal heat source; and the heat roller contacts the outside surface of at least one of the first rotating body and the second rotating body.

Because the heating unit in this sheet manufacturing apparatus is configured with a heat roller, and the roller-shaped rotating body is heated by the heating unit from the surface side, thermal efficiency is even greater.

In a sheet manufacturing apparatus according to the invention the diameter of the heat roller may be smaller than the diameter of the first rotating body or second rotating body that the heat roller contacts.

Because the diameter of the first rotating body or second rotating body that the heat roller contacts is greater than the diameter of the heat roller in this sheet manufacturing apparatus, the first rotating body can be heated even more efficiently.

In a sheet manufacturing apparatus according to the invention, there may be multiple heat rollers.

This sheet manufacturing apparatus can easily supply more heat to the rotating body. As a result, heat can be transferred more easily even when a large amount of heat is applied to the material. This sheet manufacturing apparatus can also easily heat the outside surface even when the hardness of the rotating body is low, for example.

In a sheet manufacturing apparatus according to the invention the thermal conductivity of the first rotating body is less than the thermal conductivity of the second rotating body; and the heating unit heats the outside surface of the first rotating body.

This sheet manufacturing apparatus can easily heat the outside surface of the low thermal conductivity first rotating body, and can reduce temperature variations in the outside surface of the first rotating body.

In a sheet manufacturing apparatus according to the invention the first rotating body may be a belt.

Because the first rotating body in this sheet manufacturing apparatus is a belt, a large nip width can be achieved and heat can be more easily transferred to the material.

In a sheet manufacturing apparatus according to the invention the temperatures of the first rotating body and the second rotating body are mutually different when forming the sheet.

The sheet manufacturing apparatus in this configuration makes it more difficult for material to stick to the first rotating body and or second rotating body, and can stably convey the material and sheet.

In a sheet manufacturing apparatus according to the invention the temperature difference of the first rotating body and the second rotating body when forming the sheet is 10° C. or more.

The sheet manufacturing apparatus in this configuration makes it more difficult for material to stick to the first rotating body and or second rotating body, and can more stably convey the material and sheet.

In a sheet manufacturing apparatus according to the invention the hardness of the first rotating body is less than the hardness of the second rotating body, and the heat roller contacts the first rotating body.

In this sheet manufacturing apparatus, the efficiency of thermal conductivity is even greater because heat is supplied from the heat roller to a softer first rotating body, and a large contact area can be created between the heat roller and the first rotating body. Furthermore, by setting the heat roller in contact with the outside surface of the first rotating body, the surface can be raised to a high temperature more easily than when the heat source is inside the first rotating body.

Furthermore, by heating the outside surface, the outside surface can easily be raised to a high temperature even when the material of the first rotating body is a material that is a poor conductor of heat to the surface of the first rotating body when the heat source is disposed inside the first rotating body, or is a material that may melt or deteriorate when the internal heat source reaches a high temperature.

When the material is held between the first rotating body and the second rotating body, a large nip width can be achieved when heating and compressing the sheet because of the hardness difference, and a larger contact area with the material can be achieved than when the hardness of both rollers is high, and the material can be heated more sufficiently.

In a sheet manufacturing apparatus according to the invention the hardness of the first rotating body is less than or equal to the hardness of the second rotating body by 40 points or more on the Asker-C hardness scale.

Because the area where the first rotating body and the second rotating body contact increases in this sheet manufacturing apparatus, a sufficient nip width can be achieved when heating and compressing the sheet.

In a sheet manufacturing apparatus according to the invention the temperature of the first rotating body is greater than the temperature of the second rotating body by 10° C. or more when forming the sheet.

Because the temperature of the softer first rotating body is high and the temperature of the second rotating body with greater hardness is low in this sheet manufacturing apparatus, it is difficult for material to stick to the first rotating body and the second rotating body, and the material or sheet can be conveyed more stably.

A sheet manufacturing apparatus according to another aspect of the invention also has a control unit for controlling the temperature of the heating unit.

Because the heating unit in this sheet manufacturing apparatus heats the outside surface of at least one of the first rotating body and the second rotating body, and the temperature of the heating unit is controlled, the target temperature can be achieved more quickly in the surface of the rotating body.

A sheet manufacturing apparatus according to another aspect of the invention is a sheet manufacturing apparatus configured to form a sheet by heating and compressing material containing fiber and resin, including: a roller pair including a first roller and a second roller with greater thermal conductivity than the first roller for holding, heating, and compressing material by the first roller and second roller; a heating unit for heating the outside surface of the first roller; and a control unit for controlling the temperature of the heating unit.

Because the heating unit in this sheet manufacturing apparatus heats the first roller from the outside surface and the temperature of the heating unit is controlled, the surface temperature of the first roller can be more quickly set to the target temperature, and the service life of the first roller can be extended compared with heating the first roller from the inside.

In a sheet manufacturing apparatus of the invention the first roller may be a roller including foam rubber; and the second roller is a roller with greater hardness than the first roller.

This sheet manufacturing apparatus can uniformly heat the outside surface of the first roller including foam rubber and having relatively low thermal conductivity.

In a sheet manufacturing apparatus according to the invention the control unit may control the temperature of the heating unit so that the surface temperature of the outside surface of the first roller on the upstream side in the material conveyance direction is constant.

This sheet manufacturing apparatus can set the first roller against the material with a constant, stable temperature. As a result, heat variations in the manufactured sheet can be reduced.

In a sheet manufacturing apparatus according to the invention the heating unit includes multiple heat rollers configured to heat the outside surface of the first roller; and the control unit controls the temperature of one of the multiple heat rollers.

This configuration can increase the speed of heating the outside surface of the first roller, and can hold the outside surface at a stable temperature.

In a sheet manufacturing apparatus according to the invention the heat roller that is temperature-controlled by the control unit is a roller located close to the position where material is nipped in the direction of rotation of the first roller.

This configuration further stabilize the temperature of the outside surface of the first roller in the part immediately before where the first roller contacts the material.

A sheet manufacturing apparatus according to the invention preferably also has a detection unit that detects the surface temperature of the outside surface of the first roller; and the control unit controls the temperature of the heat roller based on an average temperature of the surface temperatures of the outside surface of the first roller detected by the detection unit during a specific period of time.

This configuration can further stabilize the temperature of the outside surface of the first roller.

In a sheet manufacturing apparatus according to the invention the control unit determines the target temperature of the heat roller based on the target temperature of the outside surface of the first roller, and the difference between the current temperature of the heat roller and the current temperature of the outside surface of the first roller.

This configuration can further stabilize the temperature of the outside surface of the first roller.

In a sheet manufacturing apparatus according to the invention the control unit determines the heat of the heat roller based on the difference between the target temperature and the current temperature of the outside surface of the first roller.

This configuration can further stabilize the temperature of the outside surface of the first roller.

In a sheet manufacturing apparatus according to the invention the control unit determines the target temperature of the heat roller based on the last target temperature of the heat roller, and the difference between the target temperature and the current temperature of the first roller.

This configuration can further stabilize the temperature of the outside surface of the first roller.

Another aspect of the invention is a sheet manufacturing method that uses a sheet manufacturing apparatus described above, and includes a step of controlling the temperature of the heating unit so that the surface temperature of the outside surface of the first roller on the upstream side in the material conveyance direction is constant; and a step of holding, heating, and compressing material by the first roller and the second roller.

Because the heating unit in this sheet manufacturing apparatus heats the first roller from the outside surface and the temperature of the heating unit is controlled, the surface temperature of the first roller can be more quickly set to the target temperature, and the service life of the first roller can be extended compared with heating the first roller from the inside. A sheet can be easily manufactured with less heat variation because the first roller can be made to consistently contact the material of the sheet with a constant temperature.

DESCRIPTION OF EMBODIMENTS

A preferred embodiment of the invention is described below with reference to the accompanying figures. Note that the embodiments described below do not unduly limit the scope of the invention described in the accompanying claims. All configurations described below are also not necessarily essential elements of the invention.

Figure 1:
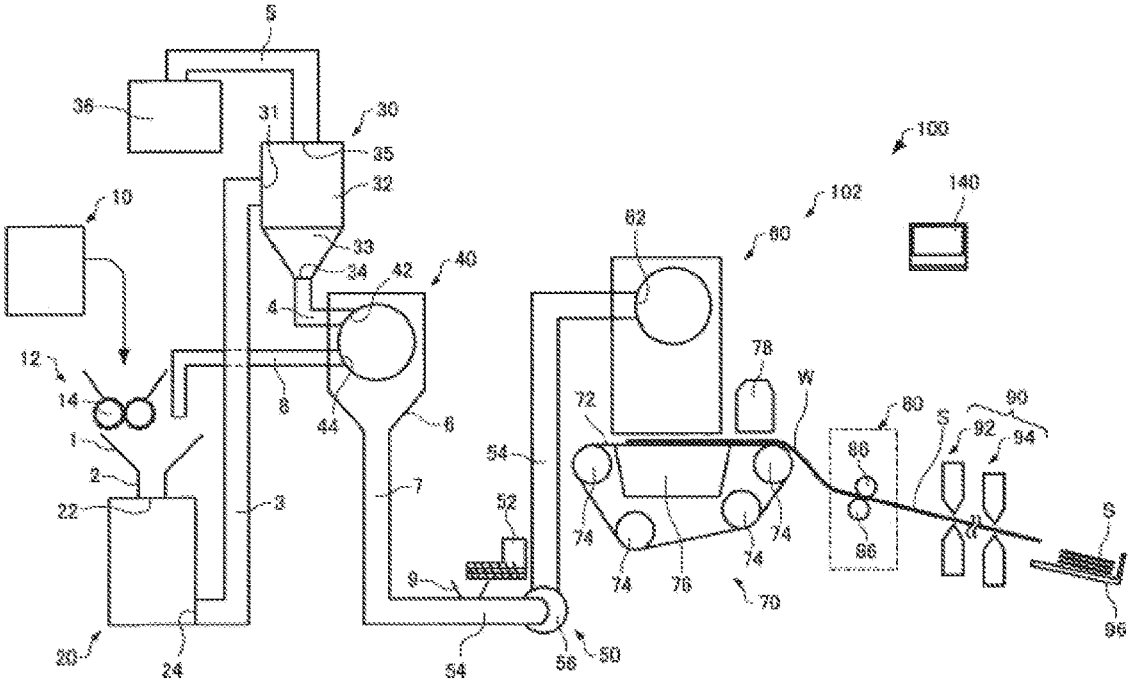
FIG. 1 illustrates a sheet manufacturing apparatus according to an embodiment of the invention.

The process units of the sheet manufacturing apparatus according to this embodiment are described first with reference to FIG. 1.

1. Sheet Manufacturing Apparatus

A sheet manufacturing apparatus according to this embodiment is described below with reference to the accompanying figures. FIG. 1 schematically illustrates a sheet manufacturing apparatus 100 according to this embodiment.

As shown in FIG. 1, the sheet manufacturing apparatus 100 has a supply unit 10, manufacturing unit 102, and control unit 140. The manufacturing unit 102 manufactures sheets. The manufacturing unit 102 includes a shredder 12, defibrating unit 20, classifier 30, separator 40, mixing unit 50, air-laying unit 60, web forming unit 70, sheet forming unit 80, and cutting unit 90.

The supply unit 10 supplies feedstock to the shredder 12. The supply unit 10 is, for example, an automatic loader for continuously supplying feedstock material to the shredder 12.

The shredder 12 cuts feedstock supplied by the supply unit 10 into shreds in air. The shreds in this example are pieces a few centimeters in size. In the example in the figure, the shredder 12 has shredder blades 14, and shreds the supplied feedstock by the shredder blades 14. In this example, a paper shredder is used as the shredder 12. The shredded material is received from the shredder 12 into a hopper 1 and carried (conveyed) to the defibrating unit 20 through a conduit 2.

The defibrating unit 20 defibrates the feedstock shredded by the shredder 12. Defibrate as used here is a process of separating feedstock (material to be defibrated) comprising interlocked fibers into individual detangled fibers. The defibrating unit 20 also functions to separate particulate such as resin, ink, toner, and sizing agents in the feedstock from the fibers.

Material that has passed through the defibrating unit 20 is referred to as defibrated material. In addition to untangled fibers, the defibrated material may also contain resin particles (resin used to bind multiple fibers together), coloring agents such as ink and toner, sizing agents, paper strengthening agents, and other additives that are separated from the fibers when the fibers are detangled. The shape of the detangled defibrated material is a string or ribbon. The detangled, defibrated material may be separated from (not interlocked with) other detangled fibers, or may be in lumps interlocked with other detangled defibrated material (in so-called fiber clumps).

The defibrating unit 20 defibrates in a dry process in air. More specifically, an impeller mill is used as the defibrating unit 20. The defibrating unit 20 can also create an air flow that sucks in the feedstock and then discharges the defibrated material. As a result, the defibrating unit 20 can suction the feedstock with the air flow from the inlet 22, defibrate, and the convey the defibrated material to the exit 24 using the air flow produced by the defibrating unit 20. The defibrated material that passed through the defibrating unit 20 is conveyed through a conduit 3 to the classifier 30.

The classifier 30 classifies the defibrated material from the defibrating unit 20. More specifically, the classifier 30 separates and removes relatively small or low density material (resin particles, coloring agents, additives, for example) from the defibrated material. This increases the percentage of relatively large or high density material in the defibrated material.

An air classifying mechanism is used as the classifier 30. An air classifier produces a helical air flow that classifies material by the difference in centrifugal force resulting from the differences in the size and density of the material, and the cut point can be adjusted by adjusting the speed of the air flow and the centrifugal force. More specifically, a cyclone, elbow-jet or eddy classifier, for example, may be used as the classifier 30. A cyclone is particularly well suited as the classifier 30 because of its simple construction.

The classifier 30 has an inlet 31, a cylinder 32 connected to the inlet 31, an inverted conical section 33 located below the cylinder 32 and connected continuously to the cylinder 32, a bottom discharge port 34 disposed in the bottom center of the conical section 33, and a top discharge port 35 disposed in the top center of the cylinder 32.

In the classifier 30, the air flow carrying the defibrated material introduced from the inlet 31 changes to a circular air flow in the cylinder 32. As a result, centrifugal force is applied to defibrated material that is introduced thereto, and the classifier 30 separates the defibrated material into fibers (first classified material) that are larger and higher in density than the resin particles and ink particles in the defibrated material, and resin particles, coloring agents, and additives (second classified material) in the defibrated material that are smaller and have lower density than the fiber in the defibrated material. The first classified material is discharged from the bottom discharge port 34, and introduced through a conduit 4 to the separator 40. The second classified material is discharged from the top discharge port 35 through another conduit 5 into a receiver 36.

The separator 40 selects fibers by length from the first classified material that passed through the classifier 30 and was introduced from the inlet 42. A sieve (sifter) is used as the separator 40. The separator 40 has mesh (filter, screen), and can separate fiber or particles smaller than the size of the openings in the mesh (that pass through the mesh, first selected material) from fiber, undefibrated shreds, and clumps that are larger than the openings in the mesh (that do not pass through the mesh, second selected material). For example, the first selected material is received in a hopper 6 and conveyed through a conduit 7 to the mixing unit 50. The second selected material is returned from the exit 44 through another conduit 8 to the defibrating unit 20. More specifically, the separator 40 is a cylindrical sieve that can be rotated by a motor. The mesh of the separator 40 may be a metal screen, expanded metal made by expanding a metal sheet with slits formed therein, or punched metal having holes formed by a press in a metal sheet.

The mixing unit 50 mixes an additive containing resin with first classified material that passed through the separator 40. The mixing unit 50 has an additive supply unit 52 that supplies additive, a conduit 54 for conveying the selected material and additive, and a blower 56. In the example in the figure, the additive is supplied from the additive supply unit 52 through a hopper 9 to a conduit 54. Conduit 54 communicates with conduit 7.

The mixing unit 50 produces an air flow with the blower 56, and can convey while mixing the selected material and additives in the conduit 54. Note that the mechanism for mixing the first selected material and additive is not specifically limited, and may mix by means of blades turning at high speed, or may use rotation of the container like a V blender.

A screw feeder such as shown in FIG. 1, or a disc feeder not shown, may be used as the additive supply unit 52. The additive supplied from the additive supply unit 52 contains resin for binding multiple fibers together. The multiple fibers are not bound when the resin is supplied. The resin melts and binds multiple fibers when passing the sheet forming unit 80.

The resin supplied from the additive supply unit 52 is a thermoplastic resin or thermoset resin, such as AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone. These resins may be used individually or in a desirable combination. The additive supplied from the additive supply unit 52 may be fibrous or powder.

Depending on the type of sheet being manufactured, the additive supplied from the additive supply unit 52 may also include a coloring agent for coloring the fiber, an anti-blocking agent to prevent fiber agglomeration, or a flame retardant for making the fiber difficult to burn, in addition to resin for binding fibers. The mixture (a mixture of first classified material and additive) that passed through the mixing unit 50 is conveyed through a conduit 54 to the air-laying unit 60.

The mixture that passed through the mixing unit 50 is introduced from the inlet 62 to the air-laying unit 60, which detangles and disperses the tangled defibrated material (fiber) in air while the mixture precipitates. When the resin in the additive supplied from the additive supply unit 52 is fibrous, the air-laying unit 60 also detangles interlocked resin fibers. The air-laying unit 60 also works to uniformly lay the mixture in the web forming unit 70.

A cylindrical sieve that turns is used as the air-laying unit 60. The air-laying unit 60 has mesh, and causes fiber and particles smaller than the size of the mesh (that pass through the mesh) and contained in the mixture that passed through the mixing unit 50 to precipitate. The configuration of the air-laying unit 60 is the same as the configuration of the separator 40 in this example.

Note that the sieve of the air-laying unit 60 may be configured without functionality for selecting specific material. More specifically, the "sieve" used as the air-laying unit 60 means a device having mesh, and the air-laying unit 60 may cause all of the mixture introduced to the air-laying unit 60 to precipitate.

The web forming unit 70 lays the precipitate that passed through the air-laying unit 60 into a web W. The web forming unit 70 includes, for example, a mesh belt 72, tension rollers 74, and a suction mechanism 76.

The mesh belt 72 is moving while precipitate that has passed through the holes (mesh) of the air-laying unit 60 accumulates thereon. The mesh belt 72 is tensioned by the tension rollers 74, and is configured so that air passes through but it is difficult for the precipitate to pass through. The mesh belt 72 moves when the tension rollers 74 turn. A web W is formed on the mesh belt 72 as a result of the mixture that passed through the air-laying unit 60 precipitating continuously while the mesh belt 72 moves continuously. The mesh belt 72 may be metal, plastic, cloth, or nonwoven cloth.

The suction mechanism 76 is disposed below the mesh belt 72 (on the opposite side as the air-laying unit 60). The suction mechanism 76 produces a downward flow of air (air flow directed from the air-laying unit 60 to the mesh belt 72). The mixture distributed in air by the air-laying unit 60 can be pulled onto the mesh belt 72 by the suction mechanism 76. As a result, the discharge rate from the air-laying unit 60 can be increased. A downward air flow can also be created in the descent path of the mixture, and interlocking of defibrated material and additive during descent can be prevented, by the suction mechanism 76.

A soft, fluffy web W containing much air is formed by material passing through the air-laying unit 60 and web forming unit 70 (web forming process) as described above. The web W laid on the mesh belt 72 is then conveyed to the sheet forming unit 80.

Note that a moisture content adjustment unit 78 for adjusting the moisture content of the web W is disposed in the example shown in the figure. The moisture content adjustment unit 78 adds water or vapor to the web W to adjust the ratio of water to the web W.

The sheet forming unit 80 applies heat and pressure to the web W laid on the mesh belt 72, forming a sheet. By applying heat to the mixture of defibrated material and additive mixed into the web W, the sheet forming unit 80 can bind fibers in the mixture together through the additive (resin).

A heat roller (heating roller), hot press molding machine, hot plate, hot air blower, infrared heater, or flash fuser, for example, may be used in the sheet forming unit 80. In the example shown in FIG. 1, the sheet forming unit 80 comprises a pair of heat rollers 86. By configuring the sheet forming unit 80 with heat rollers 86 instead of a flat press (flat press machine), a sheet S can be formed while continuously conveying the web W. Note that the number or number of sets of heat rollers 86 is not specifically limited.

The pair of heat rollers 86 in the sheet forming unit 80 may apply pressure in addition to heating the web W, and may function as a heating/compressing unit. The sheet forming unit 80 may also be configured with a pair of pressure rollers (not shown in the figure) that compress without heating the web W. A sheet forming unit 80 (indicated by the dotted line in FIG. 1) configured as a heating/compressing unit comprising a pair of rollers through which the web W passes is described in detail below.

The cutting unit 90 cuts the sheet S formed by the sheet forming unit 80. In the example in the figure, the cutting unit 90 has a first cutter 92 that cuts the sheet S crosswise to the conveyance direction of the sheet S, and a second cutter 94 that cuts the sheet S parallel to the conveyance direction. The second cutter 94 cuts the sheet S after passing through the first cutter 92, for example.

Cut sheets S of a specific size are formed by the process described above. The cut sheets S are then discharged to the discharge unit 96.

2. Heating/Compressing Unit

The sheet manufacturing apparatus according to this embodiment forms a sheet S by heating and compressing the web W in the sheet forming unit 80. As described above, the web W is formed by the air-laying unit 60 from material containing fiber and resin. The sheet forming unit 80 is a heating/compressing unit that heats and compresses the web W. In the example shown in FIG. 1, the heating/compressing unit is simply represented by a pair of heat rollers 86.

Figure 2:
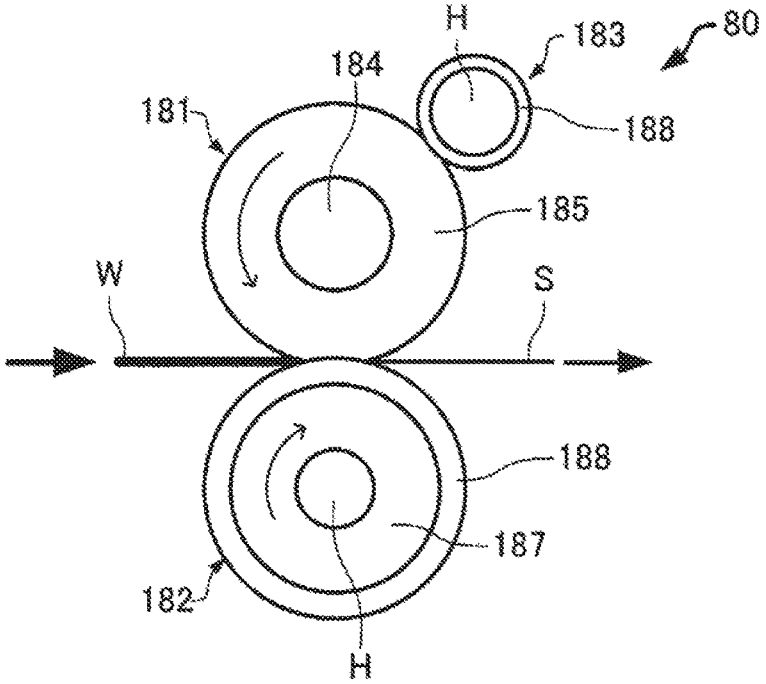
FIG. 2 shows an example of the welding unit of the sheet manufacturing apparatus according to this embodiment.
Figure 4:
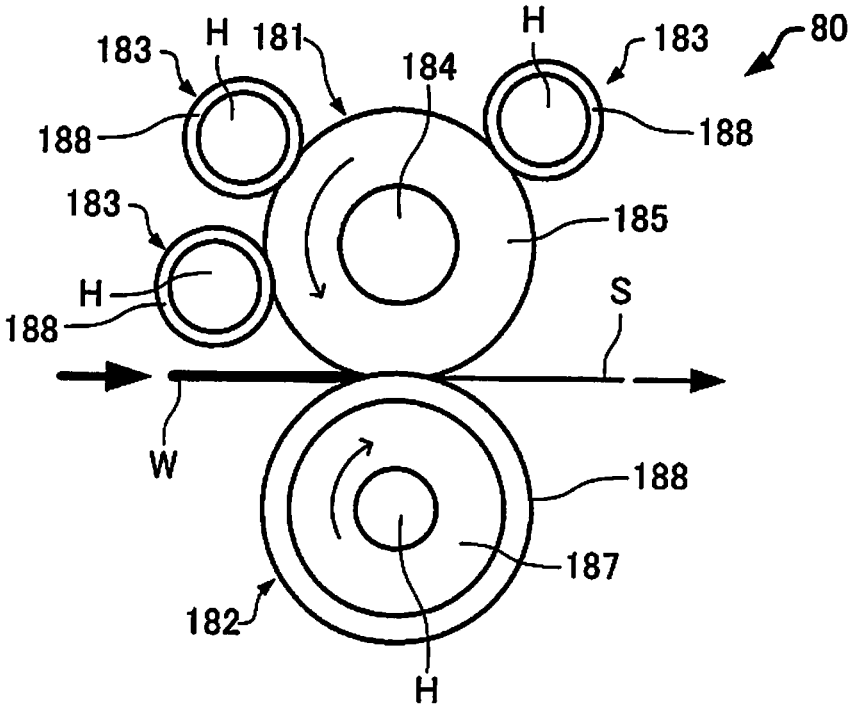
FIG. 4 shows an example of the welding unit of the sheet manufacturing apparatus according to this embodiment.
Figure 5:
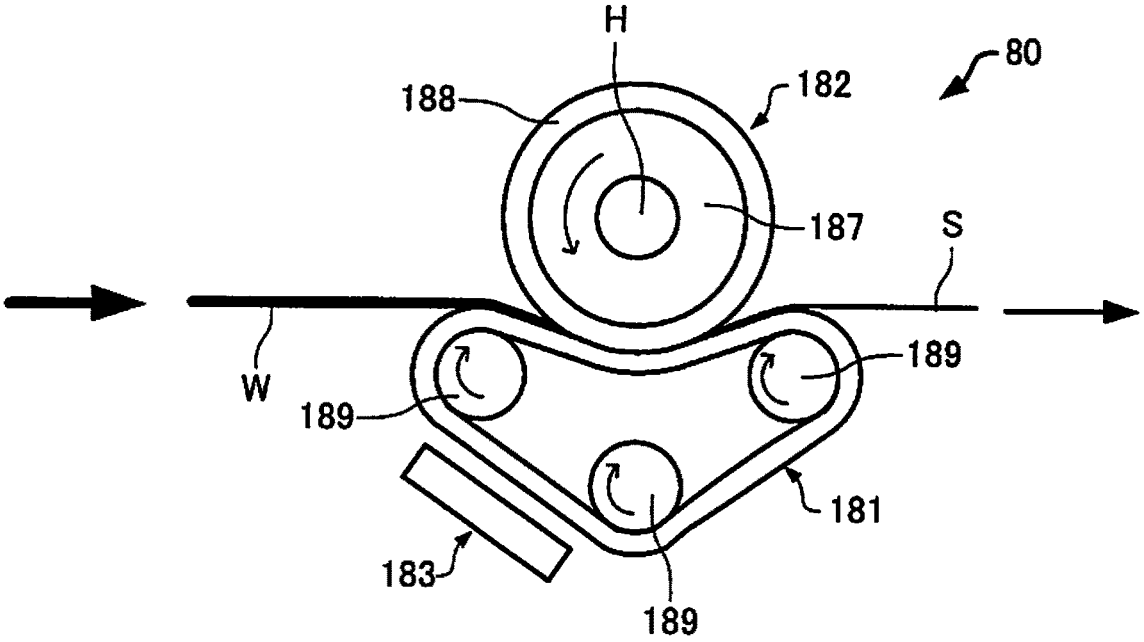
FIG. 5 shows an example of the welding unit of the sheet manufacturing apparatus according to this embodiment.

The configuration of a heating/compressing unit used as the sheet forming unit 80 in the sheet manufacturing apparatus 100 according to this embodiment is described in detail below. The heating/compressing unit 80 includes a first rotating body 181 that can turn, a second rotating body 182 that can turn, and a heating unit 183. FIG. 2, FIG. 4, and FIG. 5 show examples of different heating/compressing units according to this embodiment.

2.1. Arrangement of the First Rotating Body, Second Rotating Body, and Heating Unit As shown in FIG. 2, FIG. 4, and FIG. 5, the first rotating body 181 and second rotating body 182 each have an outside surface that moves in conjunction with rotation, and are disposed so that their outside surfaces touch in part. The first rotating body 181 and second rotating body 182 are also configured to hold, heat, and compress the web W to form a sheet S. The heating unit 183 is disposed where it can heat the outside surface of at least one of the first rotating body 181 and second rotating body 182.

The first rotating body 181 and second rotating body 182 may be shaped like a roller or a belt, for example. Both the first rotating body 181 and second rotating body 182 may be rollers, one may be a roller and the other a belt, or both may be belts. In the examples shown in FIG. 2 and FIG. 4, the first rotating body 181 and second rotating body 182 are rollers. In the example shown in FIG. 5, one of the first rotating body 181 and second rotating body 182 is a belt and the other is a roller.

When the first rotating body 181 and second rotating body 182 are both rollers as shown in FIG. 2 and FIG. 4, the axes of rotation of the rollers are parallel and separated so that some degree of pressure is applied to the web W when the web W passes between the rollers. In this configuration, one roller may be the active roller (drive roller) to which drive power is applied, or both rollers may be active rollers. When one roller is an active roller, the other may be a driven roller.

When both the first rotating body 181 and second rotating body 182 are rollers, the diameters of the rollers may be as desired. When both the first rotating body 181 and second rotating body 182 are rollers, their diameters may be the same or different. Note that the roller diameter is the diameter of the section perpendicular to the axis of rotation of the roller.

The diameter of the first rotating body 181 and second rotating body 182 is preferably large because the area that contacts the web W held therebetween is larger, but because this may also increase the size of the device, an appropriate diameter is selected. Note that the area of contact between the rotating body and the web W is the product of the length of the area contacting the web W in the direction along the axis of rotation of the roller, and the length of the area that contacts the web W in the circumferential direction of the roller. Herein, the length of the area that contacts the web W in the direction around the circumference of the roller is referred to as the nip width.

As shown in FIG. 5, when one of the first rotating body 181 and second rotating body 182 is a roller and the other is a belt, the belt is pressed against the roller with tension sufficient to apply pressure to the web W when the web W is held between the belt and the roller. This configuration can increase the area that contacts the rotating body when the web W is held between the roller and the belt.

The heating unit 183 may be configured as desired insofar as the heating unit 183 can heat the outside surface of the first rotating body 181 or the second rotating body 182, and may heat the first rotating body 181 or second rotating body 182 by contacting the outside surface or without contacting the outside surface.

In the examples shown in FIG. 2 and FIG. 4, the heating unit 183 is a heat roller disposed with its outside surface in contact with the outside surface of the first rotating body 181. In the example in FIG. 5, the heating unit 183 is an electric heater disposed with a gap to the outside surface of the first rotating body 181 (belt). Multiple heating units 183 may be provided, and configurations that heat by contact and configurations that heat without contact may be combined.

Examples of configurations of a heating unit 183 that contacts the outside surface of the first rotating body 181 or the second rotating body 182 include heat rollers (heating rollers) and hot plates. Examples of configurations of a heating unit 183 that does not contact the outside surface of the first rotating body 181 or the second rotating body 182 include heating by radiant heat from an electric heater or halogen heater, microwave heating, induction heating, and hot air.

The outside surface that the heating unit 183 heats is the outside surface of at least one of the first rotating body 181 and second rotating body 182. When the heating unit 183 heats the outside surface of a rotating body, a heater or other heat source inside the rotating body is not required. However, a heat source may also be provided inside the rotating body.

In the examples shown in FIG. 2, FIG. 4, and FIG. 5, the second rotating body 182 is a heat roller having a heat source H in the center. Because the first rotating body 181 is configured with a soft material in this example, a large nip width can be achieved even if the second rotating body 182 is made of metal or other hard material. Because the roller material does not deteriorate easily in this case, the reliability of the second rotating body 182 is not easily impaired even if a heat source H is provided thereinside.

2.2. First Rotating Body, Second Rotating Body, and Heat Unit

FIG. 2 shows an example in which the heating/compressing unit used as the sheet forming unit 80 is configured with a roller-shaped first rotating body 181, a roller-shaped second rotating body 182, and a roller-shaped heating unit 183.

In the example in FIG. 2 the heating unit 183 is a heat roller, and is configured so that the heat roller contacts the roller-shaped first rotating body 181 and can heat the outside surface of the first rotating body 181. The first rotating body 181 also contacts the roller-shaped second rotating body 182, and the web W is inserted where the rollers touch. The web W is then heated and compressed while being conveyed by rotation of the first rotating body 181 and second rotating body 182, and a sheet S is discharged. In other words, the first rotating body 181 and second rotating body 182 are configured to hold, heat, and compress the web W.

In the example in FIG. 2, the first rotating body 181 comprises a core 184 at the axis of rotation, and a soft body 185 around the core 184. The core 184 is metal, such as aluminum, steel, or stainless steel; and the soft body 185 is made from silicone rubber, urethane rubber, fluoro rubber, nitrile rubber, butyl rubber, or acrylic rubber, for example. The soft body 185 may also be foam rubber. The roller-shaped first rotating body 181 may also comprise the soft body 185 without a core 184 insofar as mechanical strength is maintained.

A layer containing a fluoroelastomer such as PFA (tetrafluoroethylene-perfluoroalkylvinylether copolymer) or PTFE (polytetrafluoroethylene), or a release layer not shown of a fluoroelastomer coating such as PTFE, may also be disposed to the surface of the first rotating body 181.

In the example shown in FIG. 2, the second rotating body 182 and heating unit 183 are configured from heat rollers. The heat roller comprises a hollow core 187 of aluminum, steel, or stainless steel, for example. A release layer 188 comprising a fluoroelastomer layer of PFA or PTFE, or a fluoroelastomer coating such as PTFE, is disposed to the surface of the heat roller. The release layer 188 may be disposed as needed. Note that an elastic layer of silicone rubber, urethane rubber, or cotton, for example, may also be disposed between the core 187 and the release layer 188.

A halogen heater is disposed as the heat source H inside the heat roller (inside the core 187). The heat source H is controlled to keep the surface temperature of the heat roller at a specific temperature. The heat source H is not limited to a halogen heater, and may use heat from a contactless heater or heat from hot air, for example. The configurations of the second rotating body 182 and heating unit 183 (the thickness and material of the release layer and the core, outside diameter of the roller) may also be the same or different.

The load applied to the rollers of the first rotating body 181, second rotating body 182, and heating unit 183 in the example shown in FIG. 2 is not specifically limited, and is set desirably within a range enabling applying specific pressure to the web W or sheet S, and applying a specific amount of heat from the heating unit 183 to the first rotating body 181.

Figure 3:
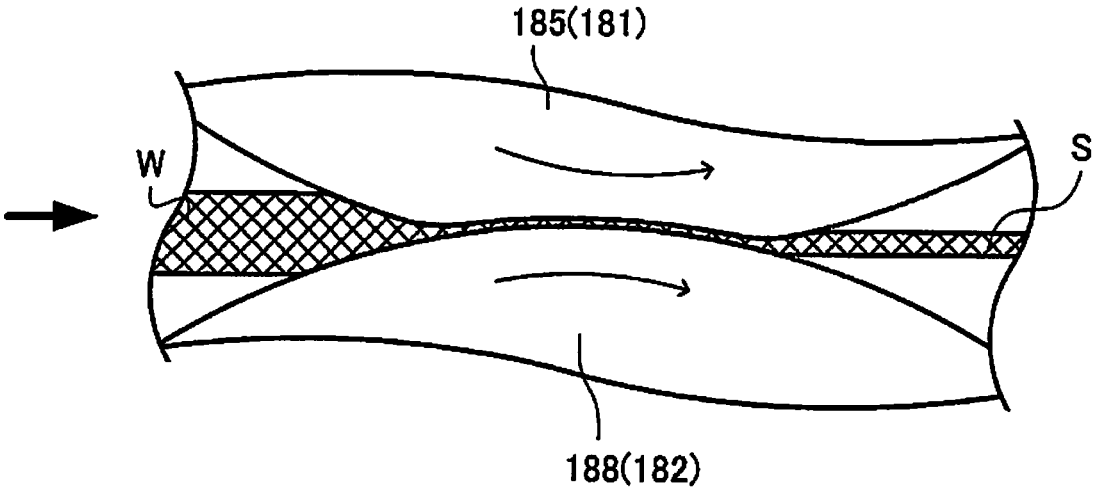
FIG. 3 is an enlarged view of the welding unit of the sheet manufacturing apparatus according to this embodiment.

FIG. 3 is an enlarged view of the area where the first rotating body 181 and second rotating body 182 in the configuration shown in FIG. 2 touch. Because one of the pair of rollers, first rotating body 181, has a soft body 185 in the example shown in FIG. 2, the contact surface of the first rotating body 181 deforms more easily than the contact surface of the second rotating body 182 when the first rotating body 181 and second rotating body 182 are pushed together. As shown in FIG. 3, the nip width can be increased as a result of deformation of the first rotating body 181 when the web W or sheet S is heated and compressed. In addition, because the contact area is greater than when the the first rotating body 181 and second rotating body 182 have the same hardness, the web W or sheet S can be heated more efficiently.

To increase the nip width in this way, there is preferably a difference in the hardness of the first rotating body 181 and second rotating body 182, for example, a difference of 30 points or more, preferably a difference of 40 points or more, and further preferably a difference of 50 points or more on the Asker-C hardness scale (The Society of Rubber Science and Technology, Japan, specification SRIS-0101-1968). If the hardness difference is in this range, the nip width can be easily set to 10 mm<=40 mm, preferably to 15 mm<=30 mm, and further preferably to 15 mm<=25 mm. In addition, if the hardness difference is in this range, the contact pressure (the pressure of the bodies pressed together) can be easily set to 0.1 $kgf/mm^2$<=10 $kgf/mm^2$, preferably 0.5 $kgf/mm^2$<=5 $kgf/mm^2$, and further preferably 1 $kgf/mm^2$<=3 $kgf/mm^2$, for example.

FIG. 4 shows an example of a configuration having multiple heating units 183 in contact with the outside surface of the first rotating body 181. As shown in FIG. 4, by providing multiple heating units 183, the outside surface of the first rotating body 181 can be heated even more easily than when the hardness of the first rotating body 181 is low.

In the examples in FIG. 2 and FIG. 4, the heating unit 183 heats only the outside surface of the first rotating body 181, but a heating unit that heats the outside surface of the second rotating body 182 may also be provided. Also in the examples in FIG. 2 and FIG. 4, a soft body 185 is disposed to only the first rotating body 181, but a roller having a soft body 185 (such as a roller configured identically to the first rotating body 181) may also be used for the second rotating body 182. This enables further increasing the nip width.

Furthermore, because the contact area of the first rotating body 181 and the heating unit 183 can be increased when the first rotating body 181 has a soft body 185 as shown in the example in FIG. 2 even if the heating unit 183 is a heat roller with high hardness, the efficiency of heating the outside surface of the first rotating body 181 can be increased.

FIG. 5 shows an example of a configuration in which the heating/compressing unit used as the sheet forming unit 80 comprises an endless belt as the first rotating body 181, a roller as the second rotating body 182, and a contactless heating unit 183.

In the example in FIG. 5 the heating unit 183 is an electric heater, and is configured to heat the outside surface of the belt of the first rotating body 181 with radiant heat from the heater. The first rotating body 181 contacts the roller-shaped second rotating body 182, and the web W is inserted where the first rotating body 181 and second rotating body 182 meet. By turning the first rotating body 181 and second rotating body 182, the web W is heated and compressed while being conveyed, and a sheet S is discharged. In other words, the first rotating body 181 and second rotating body 182 are configured to hold, heat, and compress the web W.

When the first rotating body 181 is a belt as shown in the example in FIG. 5, the material of the belt is not specifically limited, and may contain metal, rubber or fiber, for example. When the first rotating body 181 is a belt, the material of the belt is selected so that mechanical strength and contact pressure with the second rotating body 182 can be maintained when tensioned by the tension rollers 189.

A layer containing a fluoroelastomer such as PFA (tetrafluoroethylene-perfluoroalkylvinylether copolymer) or PTFE (polytetrafluoroethylene), or a release layer not shown of a fluoroelastomer coating such as PTFE, may also be disposed to the surface when the first rotating body 181 is a belt.

In the example in FIG. 5, the second rotating body 182 comprises a heat roller. The heat roller is the same as described in FIG. 2 and FIG. 4, and further description thereof is omitted. The heating unit 183 in the example in FIG. 5 is an electric heater that heats the outside surface of the belt, but heating by radiant heat from a halogen heater, microwave heating, or hot air heating may be used. If the belt material includes metal, induction heating may also be used. While not shown in the figures, a hot plate may also be used instead of a heat roller (heating roller) that contacts the outside surface of the belt.

In the example in FIG. 5, a roller (second rotating body 182) is pressed against a tensioned belt (first rotating body 181). However, while not shown in the figure, the tension rollers 189 may be pressed to the roller (second rotating body 182) with the belt therebetween. While also not shown in the figure, the other rollers may also be combined as the first rotating body 181.

The load applied to the first rotating body 181 and second rotating body 182 in the example shown in FIG. 5 is not specifically limited, and is set desirably within a range enabling applying specific pressure to the web W or sheet S, and applying a specific amount of heat from the heating unit 183 to the first rotating body 181.

2.3. Temperature of the First Rotating Body and Second Rotating Body

The heat applied to the web W in the sheet forming unit 80 when the sheet manufacturing apparatus 100 is operated to manufacture a sheet S is set appropriately in a range that enables the additive in the web W to bind fibers but does not deteriorate the material. The temperature of the first rotating body 181 and second rotating body 182 in the sheet forming unit 80 (heating/compressing unit) can therefore be set as desired within the limits achieving this ability. The temperature of the rotating body is the temperature of the outside surface when in contact with the web W, but if the heat capacity of the rotating body is great, may be expressed as the average temperature of the entire outside surface of the rotating body.

The temperatures of the first rotating body 181 and second rotating body 182 when forming a sheet S may be the same or different. If the temperature of the first rotating body 181 and second rotating body 182 when forming a sheet S is the same, the web W or sheet S can be heated uniformly from both sides, and curling of the sheet S, for example, can be suppressed.

If the temperature of the first rotating body 181 and second rotating body 182 when forming a sheet S are different, a temperature differential can be created through the thickness of the sheet S, heat shrinkage can be increased on the side with the higher surface temperature, the sheet S will tend to curl toward the side with the higher surface temperature, and a tendency for the sheet S to stick to the first rotating body 181 or the second rotating body 182 can be suppressed. When the temperature of the first rotating body 181 and second rotating body 182 when forming a sheet S are different, the temperature difference is preferably 5° C. or more, further preferably 7° C. or more, yet further preferably 10° C. or more, and yet further preferably 15° C. or more. This can make it even more difficult for the sheet S to stick to the first rotating body 181 or the second rotating body 182.

When the hardness of the first rotating body 181 and second rotating body 182 differs, the temperature of the rotating body with the greater hardness (the second rotating body 182 in the examples shown in FIG. 2, FIG. 4, and FIG. 5) is preferably lower. In this case, the tendency for the sheet S to follow the rotating body with the higher hardness as a result of deformation due to the hardness difference of the rotating bodies, and the tendency for the sheet S to curl to the side with the higher surface temperature due to the temperature difference through the thickness of the sheet S, cancel each other out, and the sheet S can more effectively be prevented from sticking to the rotating body with the higher hardness.

2.4. Operating Effect

If the outside surface of the first rotating body 181 and/or second rotating body 182 is heated by the heating unit 183, there is no need to provide a heat source H in the axial center of the first rotating body 181 and/or second rotating body 182. Because the outside surface that contacts the web W and sheet S can be heated directly by the heating unit 183, heat energy can be transmitted more efficiently to the web W and sheet S. Note that a heat source H may be disposed in the axial middle even when a heating unit 183 is provided to heat the outside surface of the first rotating body 181 and/or second rotating body 182.

If a roller with a soft body 185 is used as the first rotating body 181 and/or second rotating body 182 and the outside surface is heated by a heating unit 183, the soft body 185 deforms due to the contact pressure with the heating unit 183, and the contact area between the heating unit 183 and the first rotating body 181 and/or second rotating body 182 can be increased. As a result, the efficiency of heat transmission from the heating unit 183 to the first rotating body 181 and/or second rotating body 182 can be increased. Heating is also more efficient if the outside diameter of the first rotating body 181 and/or second rotating body 182 is greater than the outside diameter of the heating unit 183 (the outside diameter of the heat roller of the heating unit 183 is less than the outside diameter of the roller in the first rotating body 181 or the second rotating body 182 that the heating unit 183 contacts and heats).

If a roller with a soft body 185 is used in the first rotating body 181 and/or second rotating body 182, and the material of the soft body 185 is a polymer such as a silicon resin, urethane resin, or fluororesin, deterioration may result from heat. If the heat source H for the roller is in the axial center of the roller, the temperature near the center of rotation must be controlled to a higher temperature to maintain the temperature of the outside surface of the roller at a specific temperature.

However, because the heating unit 183 contacts the outside surface of the first rotating body 181 and/or second rotating body 182, the surface can be more easily held to a high temperature than when the heat source H is inside the first rotating body 181 and/or second rotating body 182.

Furthermore, by heating the outside surface, the temperature of the outside surface can be easily raised to a high temperature and deterioration of the material can be impeded even if the material of the first rotating body 181 or the second rotating body 182 is a material that is a poor conductor of heat to the surface of the rotating body when a heat source is disposed inside the rotating body, or is a material that may melt or deteriorate if the internal heat source reaches a high temperature (such as if a urethane foam in the examples of the soft body 185 described above is used), because heat is not conducted from a high temperature core. A long service life and high reliability can therefore be achieved by using this type of heating/compressing unit in the sheet manufacturing apparatus.

Furthermore, when there is a hardness difference between the first rotating body 181 and second rotating body 182, the nip width when the material is held while heating and compressing the sheet is greater than when both are rollers with high hardness, and the material can be heated more sufficiently.

Several exemplary configurations of the first rotating body, second rotating body, and heating unit are described above, but the first rotating body, second rotating body, and heating unit may be combined in various ways, and the number and configuration of each can be determined as desired.

3. Temperature Control of the First Rotating Body and Second Rotating Body 3.1. Configuration A sheet manufacturing apparatus according to this embodiment is a sheet manufacturing apparatus that forms a sheet by heating and compressing material containing fiber and resin, and has: a roller pair including a first roller and a second roller with higher thermal conductivity than the first roller for holding, heating, and compressing material with the first roller and second roller; a heating unit for heating the outside surface of the first roller; and a control unit for controlling the temperature of the heating unit.

Temperature control of the surface (outside surface) of the first roller 191 is described below using as an example a configuration having a roller pair using a first roller 191 as the first rotating body 181 described above and a second roller 192 as the second rotating body 182 described above to hold, heat, and compress material. In this example, the heating unit 183 described above is a heat roller (heating unit) that contacts the first roller 191 and heats the outside surface of the first roller 191, and is configured with three heat rollers, heat roller 193*a*, heat roller 193*b*, heat roller 193*c*, in contact with the one first roller 191.

Figure 6:
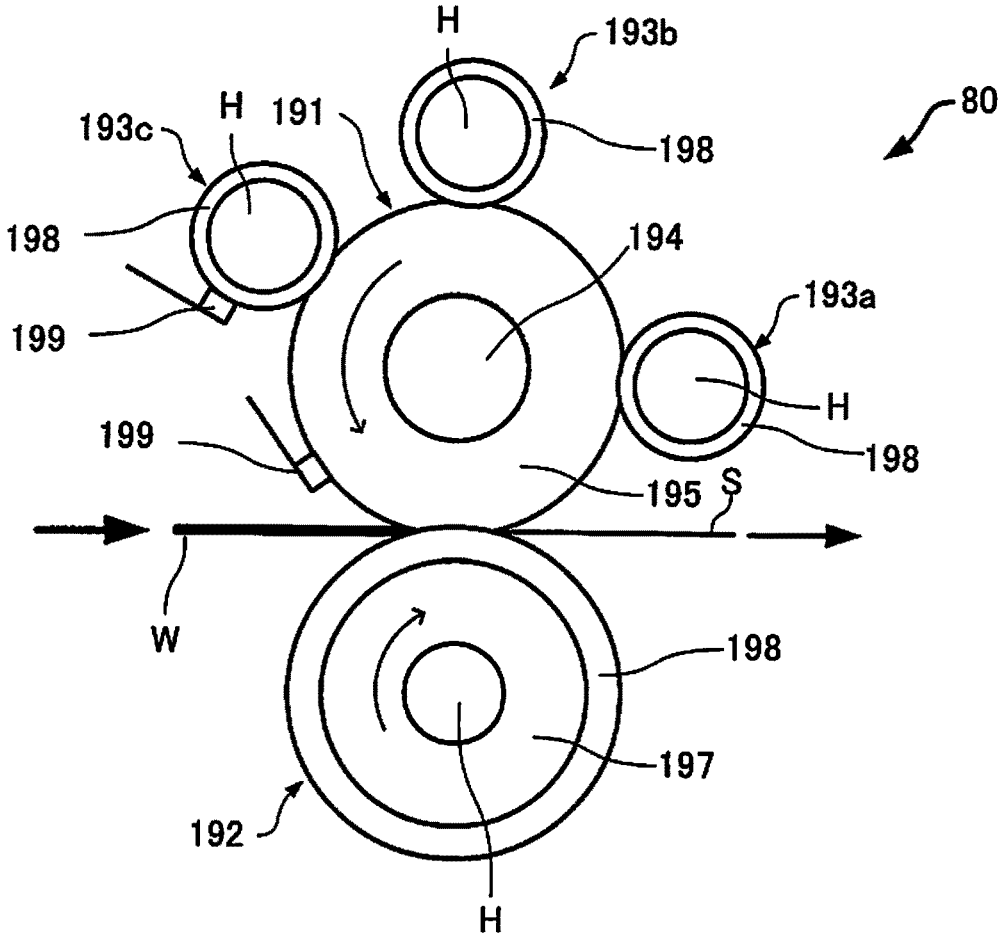
FIG. 6 shows an example of the welding unit of the sheet manufacturing apparatus according to this embodiment.

FIG. 6 shows an example of the configuration of a sheet forming unit 80 (heating/compressing unit) using temperature control according to this embodiment. In the example in FIG. 6, the first roller 191 and second roller 192 of the sheet forming unit 80 each have an outside surface that moves in conjunction with rotation, and are disposed so that the outside surfaces touch in part. They are also configured so that the web W is held between and heated and compressed by the first roller 191 and second roller 192 to form a sheet S. In this example the first roller 191 is made from materials including foam rubber 195 (comparable to the soft body 185 described above), and has a core 194 at the center of rotation with foam rubber 195 around the core 194.

The second roller 192 is built with a release layer 198 formed on the outside surface of a metal core 197. The thermal conductivity of the first roller 191 with the foam rubber 195 is therefore lower than the second roller 192. The surface hardness of the first roller 191 with the foam rubber 195 is also lower than the surface hardness of the second roller 192.

As shown in FIG. 6, because both the first roller 191 and second roller 192 are rollers, the axes of rotation of the rollers are parallel and separated so that some degree of pressure is applied to the web W when the web W passes between the rollers. The heat roller 193*a*, heat roller 193*b*, heat roller 193*c* contact and heat the outside surface of the first roller 191 of the first roller 191.

A halogen heater is disposed as the heat source H inside heat roller 193*a*, heat roller 193*b*, and heat roller 193*c* (inside the core 197). The amount of heat (energy) applied by the heat source H is controlled so that the surface temperature of the heat roller is held at a specific temperature.

A thermistor 199 is also disposed touching the surface of the heat roller 193*c* as a detection unit to detect the temperature of the outside surface of each roller. The thermistor 199 detects the temperature of the part where it touches the roller, and outputs a signal. A thermistor not shown is also disposed to the surface of heat roller 193*a*, heat roller 193*b*, and second roller 192. Multiple thermistors may also be disposed to each roller.

The heat rollers, first roller 191, second roller 192, and thermistors 199 are connected to a control unit not shown, and control the rotation and temperature of each roller. Note that if there are multiple heat rollers as shown in FIG. 6, the surface temperature of the first roller 191 is controlled to a specific temperature if at least one of the heat rollers is controlled as described below.

A thermistor 199 is disposed to the first roller 191 on the upstream side in the conveyance direction of the material. More specifically, the thermistor 199 disposed to the first roller 191 detects the temperature (the surface temperature of the outside surface on the upstream side of the conveyance direction of the material) on the upstream side of where (immediately before) the first roller 191 contacts the material (web W). The control unit controls the temperature of the heat roller 193*c* so that the surface temperature of the first roller 191 at this position remains constant. Note that the temperature of the heat roller 193*c* is controlled based on a signal from the control unit to adjust the energy (heat) applied to the heat source H of the heat roller 193*c*.

3.2. Control

Some examples of temperature control of the first roller 191 in this embodiment of the invention are described below. When the first roller 191 contacts the material (web W) at a specific temperature, heat is taken from the surface and the surface temperature of the outside surface drops. As the first roller 191 continues turning, the outside surface contacts the heat rollers and is heated, and is returned to the specific temperature by the time the surface next contacts the material. The heat taken from the first roller 191 is consumed by melting the resin and evaporating moisture, for example.

Based on the temperature of the first roller 191 immediately before touching the material, this embodiment of the invention controls the temperature of the heat roller 193*c* disposed farthest in the direction of rotation of the first roller 191 from the position where the material is nipped.

Control Method 1

A control method based on the following control equation (1) is described below.

$$Q=k_1\{T_{m,t}+k_2(T_{e,c}-T_{m,c})-T_{e,c}\} \quad (1)$$

In equation (1), Q is the heat (energy) applied to the heat roller 193*c*; T is the surface temperature (acquired by the respective thermistor 199) of the roller identified by the index; and $k_1$ and $k_2$ are proportional constants. Note that index m denotes the first roller 191; e denotes the heat roller 193*c*; t denotes the target temperature; and c denotes the current temperature. As a result, represents the target temperature of the first roller 191; $T_{e,c}$ represents the current temperature of heat roller 193*c*; and $T_{m,c}$ represents the current temperature of the first roller 191. In addition, in equation (1) $T_{m,t}+k_2(T_{e,c}-T_{m,c})-T_{e,c}$ represents the target temperature of the heat roller 193*c*.

More specifically, control by equation (1) determines the amount of heat (target temperature) to apply to the heat roller 193*c* based on the difference between the target temperature of the outside surface of the first roller 191, the current temperature of the heat roller 193*c*, and the current temperature of the outside surface of the first roller 191.

This enables bringing the temperature of the first roller 191 at the part just before contacting the material to the target temperature in less time. As a result, the target temperature can be restored and stabilized in less time even when there are external disturbances or minor deviations, such as when the amount of heat taken by the material (web W) varies.

Control Method 2

A control method based on the following control equation (2) is described below.

$$Q=k(T_{m,t}-T_{m,c}) \quad (2)$$

The same notation is used in equation (2) as in equation (1) above, $T_{m,t}$ represents the target temperature of the first roller 191; $T_{m,c}$ represents the current temperature of the first roller 191; and k is a proportional constant.

Equation (2) is the same as equation (1) when $k_2$ is 1. Control using equation (2) makes a decision based on the difference between the target temperature and the current temperature of the outside surface of the first roller 191.

This enables bringing the temperature of the first roller 191 at the part just before contacting the material to the target temperature in less time. As a result, the target temperature can be restored and stabilized in less time even when there are external disturbances or minor deviations, such as when the amount of heat taken by the material (web W) varies.

Control Method 3

A control method based on the following control equation (3) is described below.

$$Q=k_1\{T_{e,t,p}+k_2(T_{m,t}-T_{m,c})-T_{e,c}\} \quad (3)$$

In equation (1), Q is the heat (energy) applied to the heat roller 193*c*; T is the surface temperature (acquired by the respective thermistor 199) of the roller identified by the index; and $k_1$ and $k_2$ are proportional constants. Note that index e denotes the heat roller 193*c*; t denotes the target temperature; c denotes the current temperature; and m denotes the first roller 191. $T_{e,t,p}$ therefore represents the previous target temperature of the heat roller 193*c*; $T_{m,t}$ represents the target temperature of the first roller 191; $T_{m,c}$ represents the current temperature of the first roller 191; and $T_{e,c}$ represents the current temperature of the heat roller 193*c*. Note that in equation (conduit 3) $T_{e,t,p}+k_2(T_{m,t}-T_{m,c})$ represents the current target temperature of the heat roller 193*c*.

Control by equation (3) determines the target temperature of the heat roller 193*c* based on the difference between the immediately preceding (last) target temperature of the heat roller 193*c*, and the current temperature of the outside surface of the first roller 191. Control by equation (3) is a type of iterated integration control.

This enables setting the temperature of the first roller 191 at the part just before contacting the material to the target temperature in less time. As a result, the target temperature can be restored and stabilized in less time even when there are external disturbances or minor deviations, such as when the amount of heat taken by the material (web W) varies. In addition, control by equation (3) does not excessively increase the temperature of the heat roller 193*c*, and can therefore help extend the service life of the rollers and heaters.

3.3. Control Variations

The control unit may alternatively control the temperature of the heat roller 193*c* based on the average temperature of the surface temperature of the outside surface of the first roller 191 detected by the detection unit (thermistor 199) during a specific period of time. More specifically, in control methods 1 to 3 described above, $T_{m,c}$, that is, the temperature of the outside surface of the first roller 191, may be the average temperature during a specific time. This specific time is, for example, 30 seconds, preferably 20 seconds, further preferably 10 seconds, and yet further preferably 5 seconds before the temperature is measured (detected). This specific time may also be determined according to the rotational speed of the first roller 191, such as 3 rotations, preferably 2 rotations, further preferably 1 rotation, and yet further preferably 0.5 rotation before the temperature is measured (detected).

Because the first roller 191 is configured to include foam rubber, heat insulation is good (thermal conductivity is poor), and the correlation between the temperature at different circumferential positions is low. In other words, because the thermal resistance of the first roller 191 is high, heat is conducted poorly, and maintaining a uniform temperature circumferentially is difficult. As a result, feedback control of the heat applied to the heat roller 193*c* based simply on the temperature detected by a thermistor 199 at one place on the outside surface of the first roller 191 may not be appropriate.

However, by controlling the temperature of the heat roller 193*c* based on the average temperature of the surface temperature of the outside surface of the first roller 191, the average temperature around the circumference of the outside surface of the first roller 191 can be kept near the target temperature.

This example describes temperature control of one of the three heat rollers, that is, the heat roller 193*c* located closest to the position where the material is nipped in the direction of first roller 191 rotation. This control may be applied to at least one of heat roller 193*a*, heat roller 193*b*, and heat roller 193*c*, but applying temperature control to heat roller 193*c* as described above is more efficient because heat roller 193*c* is located closest to where the first roller 191 contacts the material.

4. Text Samples

The invention is further described below with reference to tests related to the described temperature control, but the invention is not limited by these test samples in any way.

FIG. 7 to FIG. 10 are graphs showing the change over time in the experimentally detected surface temperatures of heat roller 193*c* and first roller 191. In the tests, the change over time in the surface temperatures of the heat roller 193*c* and first roller 191 was measured using the control methods described above with the first roller 191, heat roller 193*c*, and thermistors 199 configured as shown in FIG. 6.

Main parameters used in these tests were: the thermal conductivity (0.05 (unit: W/(m/k))), diameter (70 mm), and length (340 mm) of the first roller 191; and the diameter (20 mm) and length (340 mm) of the heat roller 193*c*. The temperature of the outside surface of the first roller 191 was the average temperature during the preceding 5 seconds. The target temperature of the first roller 191 was 180° C.

Figure 7:
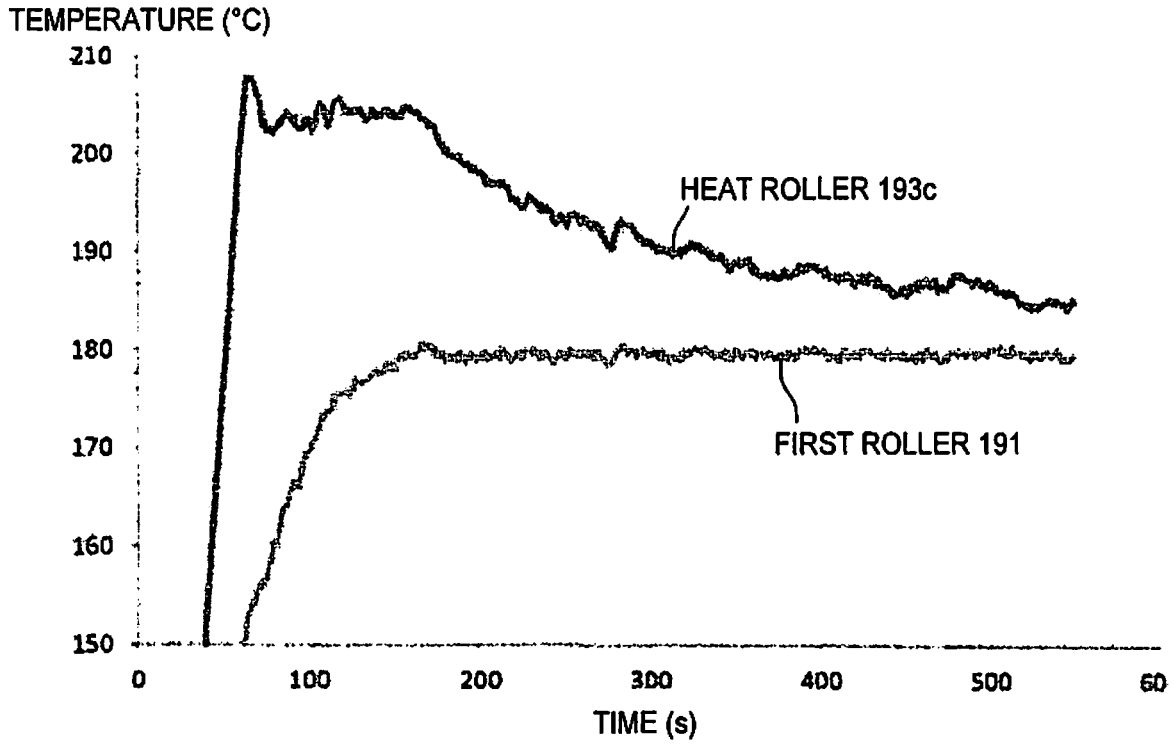
FIG. 7 is a graph showing an example of temperature control of the welding unit according to this embodiment.
Figure 8:
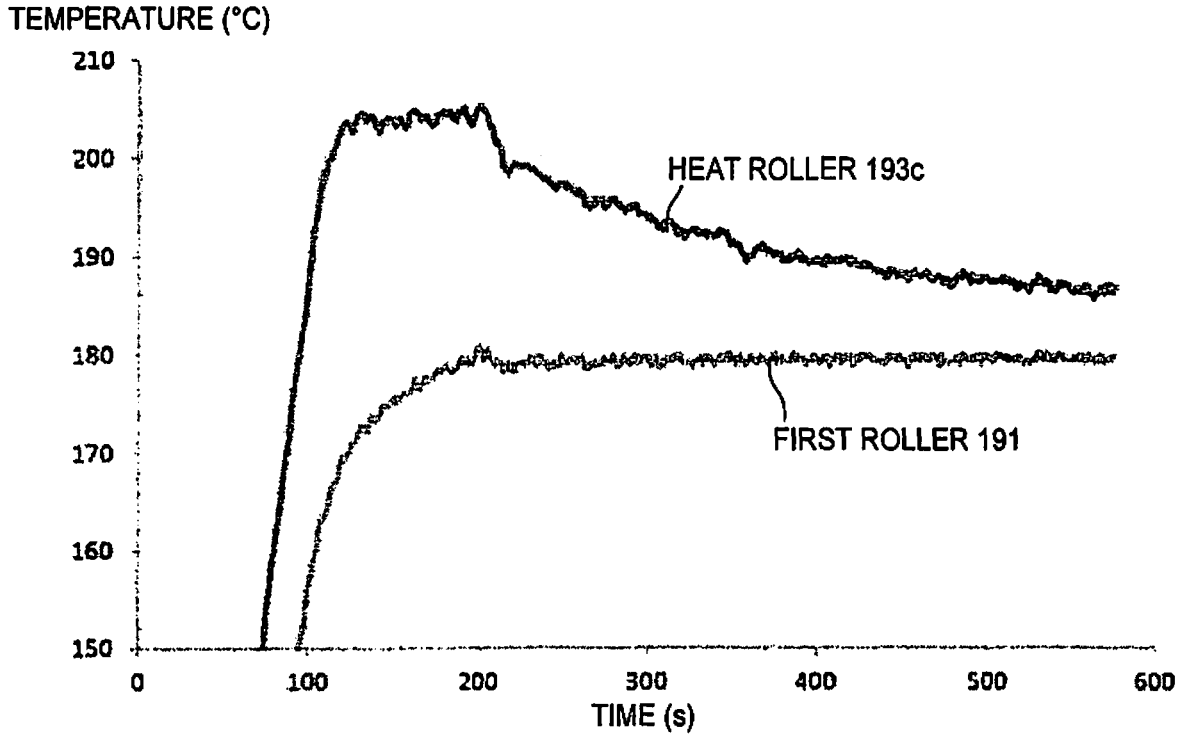
FIG. 8 is a graph showing an example of temperature control of the welding unit according to this embodiment.
Figure 9:
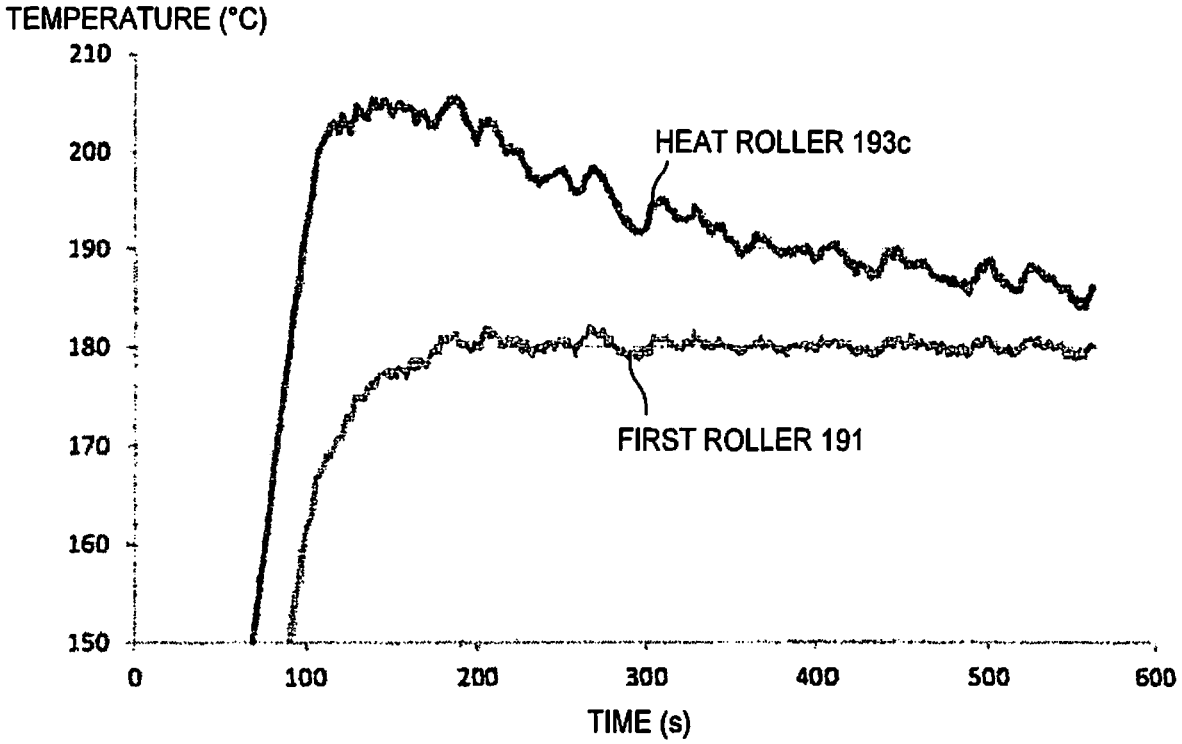
FIG. 9 is a graph showing an example of temperature control of the welding unit according to this embodiment.
Figure 10:
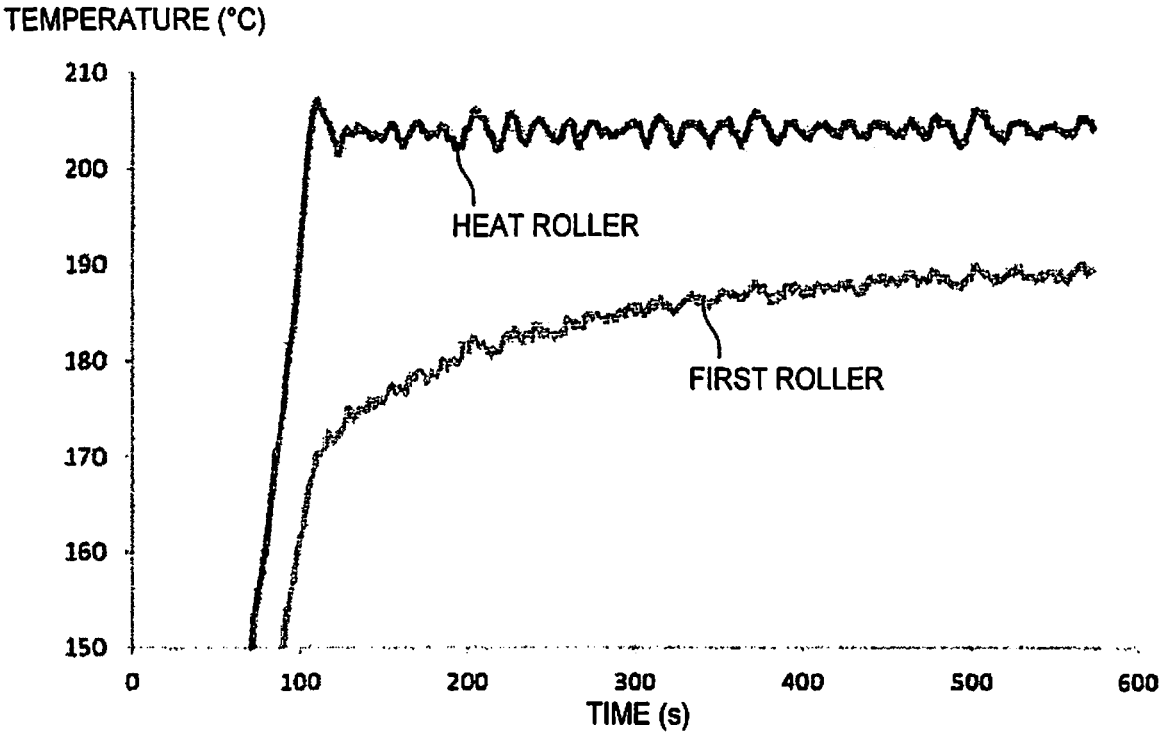
FIG. 10 is a graph showing an example of temperature control of the welding unit according to the prior art.

FIG. 7, FIG. 8, and FIG. 9 show the results of controlling the temperature of the outside surface of the first roller 191 using equation (1), equation (2), and equation (3) described above. FIG. 10 shows the results when the target temperature of the heat roller 193*c* was 205° C.

As will be understood from FIG. 7 to FIG. 9, a stable target temperature was maintained using each of equations (1) to (3). In contrast, control was not stable at the target temperature in the graph shown in FIG. 10. Some overshoot is observed when heating the heat roller 193*c* starts in the graphs in FIG. 7 and FIG. 10, but no overshoot is observed in the graphs in FIG. 8 and FIG. 9.

It is apparent from these results that the temperature of the part of the first roller 191 just before contacting the material can reach the target temperature in a short time using any of equations (1) to (3). In addition, the target temperature can be restored and stabilized in less time even when there are external disturbances or minor deviations, such as when the amount of heat taken by the material (web W) varies. Furthermore, because the temperature of the heat roller 193*c* does not become excessively high using equations (2) or (3), the service life of the heat roller 193*c* and first roller 191 can be increased.

The present invention is not limited to the embodiment described above, and can be varied in many ways. For example, the invention includes configurations (configurations of the same function, method, and effect, or configurations of the same objective and effect) that are effectively the same as configurations described in the foregoing embodiment. The invention also includes configurations that replace parts that are not essential to the configuration described in the foregoing embodiment. Furthermore, the invention includes configurations having the same operating effect, or configurations that can achieve the same objective, as configurations described in the foregoing embodiment. Furthermore, the invention includes configurations that add technology known from the literature to configurations described in the foregoing embodiment.

REFERENCE SIGNS LIST

1 hopper
2, 3, 4, 5 conduits
6 hopper
7, 8 conduits
9 hopper
10 supply unit
12 shredder
14 shredder blades
20 defibrating unit
22 inlet
24 exit
30 classifier
31 inlet
32 cylinder
33 conical section
34 bottom discharge port
35 top discharge port
36 receiver
40 separator
42 inlet
44 exit
50 mixing unit
52 additive supply unit
54 conduit
56 blower
60 air-laying unit
62 inlet
70 web forming unit
72 mesh belt
74 tension rollers
76 suction mechanism
78 moisture content adjustment unit
80 sheet forming unit
86 heat rollers
90 cutting unit
92 first cutter
94 second cutter
96 discharge unit
100 sheet manufacturing apparatus
102 manufacturing unit
140 control unit
181 first rotating body
182 second rotating body
183 heating unit
184 core
185 soft body
187 core
188 release layer
191 first roller
192 second roller
193 heat roller
194 core
195 foam rubber
197 core
198 release layer
199 thermistor
S sheet
W web
H heat source

The invention claimed is:

1. A sheet manufacturing apparatus having a heating/compressing unit configured to heat and compress material including fiber and resin and form a sheet, the heating/compressing unit including a first rotating body that rotates and has no heater inside of the first rotating body, and a second rotating body that rotates in contact with the first rotating body and has a heater inside of the second rotating body, the first rotating body having a thermal conductivity less than the second rotating body, a hardness of the first rotating body being less than a hardness of the second rotating body, a temperature of the first rotating body being greater than a temperature of the second rotating body when forming the sheet, the sheet manufacturing apparatus holding, heating, and compressing the material by the first rotating body and the second rotating body; and comprising a heating unit that heats the outside surface of the first rotating body and directly contacts the outside surface of the first rotating body, the sheet manufacturing apparatus comprising no heating unit that heats and directly contacts the outside surface of the second rotating body.

2. The sheet manufacturing apparatus described in claim 1, wherein:

the first rotating body and second rotating body are rollers; and the heating unit is a heat roller with an internal heat source.

3. The sheet manufacturing apparatus described in claim 2, wherein the diameter of the heat roller is smaller than the diameter of the first rotating body that the heat roller contacts.

4. The sheet manufacturing apparatus described in claim 2, wherein the temperature of the first rotating body is greater than the temperature of the second rotating body by 10° C. or more when forming the sheet.

5. The sheet manufacturing apparatus described in claim 2, wherein the hardness of the first rotating body is less than the hardness of the second rotating body with a difference of 40 points or more on the Asker-C hardness scale.

6. The sheet manufacturing apparatus described in claim 1, further comprising a plurality of additional heat rollers.

7. The sheet manufacturing apparatus described in claim 1, wherein:

the first rotating body is a belt; and the heating unit heats the outside surface of the first rotating body.

8. The sheet manufacturing apparatus described in claim 1, wherein the temperature of the first rotating body is greater than the temperature of the second rotating body by 10° C. or more when forming the sheet.

9. The sheet manufacturing apparatus described in claim 1, further comprising:

a control unit that controls the temperature of the heating unit and is electrically connected to the heating/compressing unit and the heating unit.

10. A sheet manufacturing apparatus configured to form a sheet by heating and compressing material containing fiber and resin, the sheet manufacturing apparatus comprising:

a roller pair including a first roller that has no heater inside of the first roller, and a second roller that has a heater inside of the second roller and has greater thermal conductivity than the first roller for holding, heating, and compressing material by the first roller and second roller, a hardness of the first roller being less than a hardness of the second roller, a temperature of the first roller being greater than a temperature of the second roller when forming the sheet;

a heating unit that heats the outside surface of the first roller and directly contacts the outside surface of the first roller; and a control unit that controls the temperature of the heating unit and is electrically connected to the roller pair and the heating unit, the sheet manufacturing apparatus comprising no heating unit that heats and directly contacts the outside surface of the second roller.

11. The sheet manufacturing apparatus described in claim 10, wherein:

the first roller is a roller including foam rubber.

12. The sheet manufacturing apparatus described in claim 10, wherein:

the heating unit comprises multiple heat rollers configured to heat the outside surface of the first roller; and the control unit controls the temperature of one of the multiple heat rollers.

13. The sheet manufacturing apparatus described in claim 12, wherein:

the heat roller that is temperature-controlled by the control unit is a roller located closest to the position where material is nipped in the direction of rotation of the first roller among the multiple heat rollers.

14. The sheet manufacturing apparatus described in claim 12, further comprising:

a detection unit that detects the surface temperature of the outside surface of the first roller;

the control unit controlling the temperature of the heat roller based on an average temperature of the surface temperatures of the outside surface of the first roller detected by the detection unit during a specific period of time.

15. The sheet manufacturing apparatus described in claim 12, wherein:

the control unit determines the target temperature of the heat roller based on the target temperature of the outside surface of the first roller, and the difference between the current temperature of the heat roller and the current temperature of the outside surface of the first roller.

16. The sheet manufacturing apparatus described in claim 12, wherein:

the control unit determines the heat of the heat roller based on the difference between the target temperature and the current temperature of the outside surface of the first roller.

17. The sheet manufacturing apparatus described in claim 12, wherein:

the control unit determines the target temperature of the heat roller based on an immediately preceding target temperature of the heat roller, and the difference between the target temperature and the current temperature of the first roller.

18. The sheet manufacturing apparatus described in claim 10, wherein:

the control unit controls the temperature of the heating unit so that the surface temperature of the outside surface of the first roller on the upstream side in the material conveyance direction is constant.

19. A sheet manufacturing method that uses a sheet manufacturing apparatus described in claim 18, and comprises:

a step of controlling the temperature of the heating unit so that the surface temperature of the outside surface of the first roller on the upstream side in the material conveyance direction is constant; and a step of holding, heating, and compressing material by the first roller and the second roller.

* * * * *